United States Patent [19]

Wolfgang

[11] 4,330,905

[45] May 25, 1982

[54] ADJUSTABLE DEPLOYMENT BAND

[75] Inventor: Herchenbach Wolfgang, Pforzheim, Fed. Rep. of Germany

[73] Assignee: Rodi & Wienenberger AG, Pforzheim, Fed. Rep. of Germany

[21] Appl. No.: 158,777

[22] Filed: Jun. 12, 1980

[30] Foreign Application Priority Data

Jun. 23, 1979 [DE] Fed. Rep. of Germany ..... 2925442
Apr. 5, 1980 [DE] Fed. Rep. of Germany ..... 3013404

[51] Int. Cl.[3] ..... A44B 21/00

[52] U.S. Cl. ..... 24/71 J; 24/68 J; 24/70 J

[58] Field of Search ..... 24/68 J, 68 ST, 71 J, 24/71 R, 70 J, 265 B

[56] References Cited

U.S. PATENT DOCUMENTS

| | | | |
|---|---|---|---|
| 1,568,617 | 1/1926 | Patten | 24/71 J |
| 1,654,732 | 1/1928 | Johnson et al. | 24/71 J |
| 1,701,041 | 2/1929 | Johnson et al. | 24/71 J |
| 1,741,421 | 12/1929 | Kraemer | 24/71 J |
| 1,746,457 | 2/1930 | Bigney et al. | 24/71 J |
| 1,780,824 | 11/1930 | Kraemer | 24/71 J |
| 1,825,156 | 9/1931 | Otten | 24/71 J |
| 1,838,590 | 12/1931 | Suttin | 24/71 J |
| 3,797,716 | 3/1974 | Mochizuki | 24/71 J |

FOREIGN PATENT DOCUMENTS

| | | | |
|---|---|---|---|
| 282167 | 4/1952 | Switzerland | 24/71 J |

*Primary Examiner*—Roy D. Frazier
*Assistant Examiner*—Peter A. Aschenbrenner
*Attorney, Agent, or Firm*—Michael J. Striker

[57] ABSTRACT

An adjustable deployment band comprising two watch band halves and a foldable closure member including a lower closure part to which one of the watch band halves is adjustably connected, an upper closure part to which one end of the other watch band is connected, and a folding part connecting the upper and the lower closure part for movement between an open and a closed position in which the closure parts interengage superimposed with each other to form a closed very shallow housing in which one end portion of the one watch band half and the folding part and the fastening member are located.

14 Claims, 6 Drawing Figures

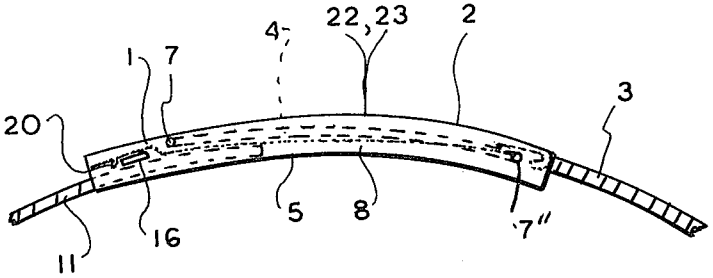
FIG. 3
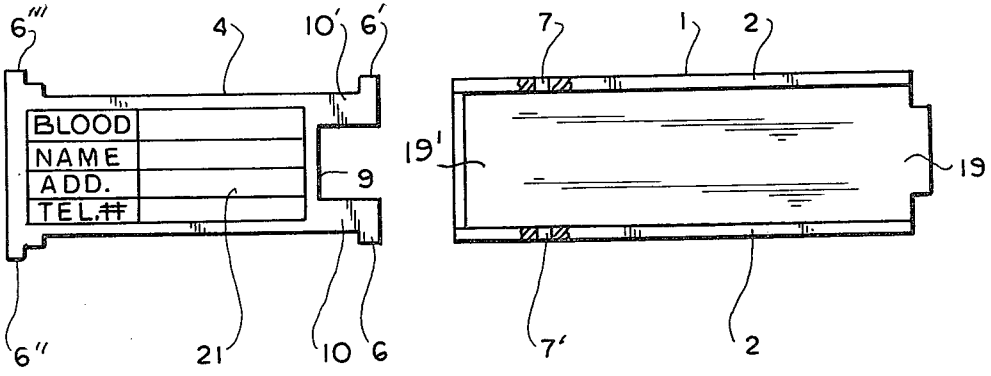
FIG. 4C
FIG. 4B
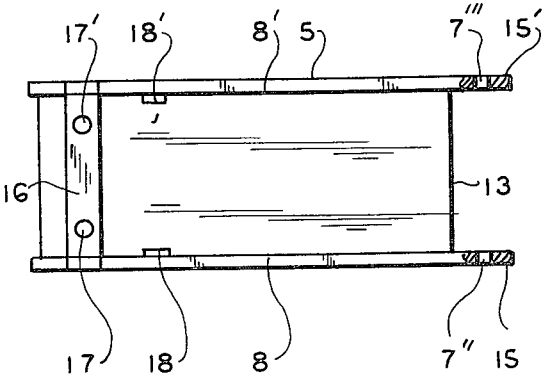
FIG. 4A

ADJUSTABLE DEPLOYMENT BAND

BACKGROUND OF THE INVENTION

The present invention relates to an adjustable deployment band including a foldable closure member in which one half of the watch band is adjustably located in a lower closure part of the closure member.

Foldable closure members for deployment bands are known in the art in which the two watch band halves and the parts of the foldable closure member are hingeably connected to each other to overlap in the closed position of the closure member. In these known closure members an adjustment of the length of the deployment band is obtained by engagement of lateral projections at the end of one watch band half with openings provided in lateral flanges of the upper closure part. These openings are spaced from each other in the flanges of the upper closure part and therefore the possibility of adjusting the deployment band is limited by the number of openings provided in the flanges.

Adjustable deployment bands are further known in which one of the watch band halves is connected to one end of the upper closure part of the foldable closure member, whereas the other watch band half is arranged movable in longitudinal direction in the lower part of the closure member and fixable therein in any adjusted position by means of clamping eccentrics located essentially above the lower band half. In these known adjustable deployment bands a sufficient and stepless change of the length thereof is possible, however, the closure member obtains due to the superimposition of five construction elements a considerable thickness which is contrary to the present trend of flat watch bands and corresponding flat foldable closure members which harmonize with the thickness of the watch band. An additional disadvantage of this known adjustable deployment band is that the various superimposed closure and band parts are visible from the side thereof which is of disadvantage for its overall appearance.

SUMMARY OF THE INVENTION

It is an object of the present invention to provide an adjustable deployment band which avoids the disadvantages of such deployment bands known in the art.

It is a further object of the present invention to provide an adjustable deployment band which is constructed in such a manner so that the foldable closure member thereof in its closed position forms a smooth very shallow unit in which the parts thereof are arranged one after the other insofar they must not be superimposed with each other for reason of function.

With these and other objects in view, which will become apparent as the description proceeds, the adjustable deployment band according to the present invention mainly comprises two watch band halves, and a foldable closure member having a lower closure part to which one of the watch band halves is adjustably connected, an upper closure part to which one end of the other watch band half is hingedly connected, and a folding part connecting the upper and the lower closure part for movement between a closed position in which the closure parts interengage superimposed with each other and an open position and in which the upper closure part has a length so that in the closed position of the closure parts the end of the other watch band half will be located not over but rearwardly of the folding part. The lower closure part is formed as a channel of substantially rectangular cross-section in which an end portion of the one watch band half is arranged shiftable and fixable in any adjusted position. The clamping eccentrics which are used in known adjustable deployment bands for clamping of a member against the adjustable watch band half is replaced in the foldable closure member according to the present invention by a fastening member which extends between the lateral flanges of the lower closure part and which carries one or two set screws by means of which the one watch band half extending beneath the fastening member may be fixed in any adjusted position. The upper closure part has a pair of downwardly extending lateral flanges between which the folding part is located in the closed position of the closure member. The height of the lateral flanges of the lower closure part is chosen in such a manner that in the closed position of the closure member the upper closure part with the folding part located between the flanges thereof will be located in the lower closure part so that the upper wall of the upper closure part will not or only to a very limited extent project beyond the upper edges of the flanges of the lower closure part.

The folding part is hingedly connected at opposite ends with the upper and the lower closure part. Trunnions projecting laterally from opposite ends of the folding part, integrally formed therewith, engage thereby in openings respectively provided in the lateral flanges of the upper and the lower closure part. This will result in a substantially flat and shallow construction.

According to the further feature of the present invention the folding part is provided at the end thereof at which it is hinged to the upper closure part of the foldable closure member with a cutout extending from an end edge thereof thereinto to provide to opposite sides of the cutout a pair of elastic lobes from which one pair of the aforementioned trunnions project so that the trunnions may be snapped into the respective openings by elastically deforming the lobes. In this way the folding part may be easily and securely connected to the upper closure part.

The folding part is substantially flat without any reinforcing creases or folds. In order to nevertheless assure a sufficient stability thereof, it is formed from sheet metal having a thickness which is substantially twice the thickness of the sheet metal from which the upper and the lower closure parts are formed. The bottom face of the folding part is used as a carrier for information of personal data of the owner of the deployment band. This bottom face of the folding part becomes automatically visible during opening of the closure member, so that for instance, during an accident the data provided on the bottom face of the folding part will be visible upon removal of the deployment band. These data may be provided on a label pasted to the bottom face of the folding part and such data may include, for instance, the blood group, etc. of the owner. Another possibility is to engrave some personal data of the owner on the bottom face of the folding part. The use of the folding part as carrier of information coincides with the desire for safety and the endeavour to have the necessary information readily available at an accident to permit quick action without any delay. The provision of personal data on a necessary construction element of the closure member avoids any for this purpose usually required additional elements, for instance a capsule, which would increase the thickness of the closure member. The closure member according to the present invention by this specific construction still remains substantially flat and the cost of the arrangement is only slightly increased.

In order to limit superimposition of the construction elements and the therefrom resulting increase of the thickness of the closure member to a minimum, the fastening member for the one watch band half is located near one end of the lower closure part so that in the closed position of the closure member the folding part will be located between the fastening member and the other watch band half which is connected to the upper closure part.

The fastening member serves at the same time as an abutment for a bent detent projecting from one end of the upper closure part which detent engages upon closing of the closure member about a front face of the fastening member.

In another modification of the closure member the flanges of the lower closure path are provided rearwardly and adjacent to the fastening member with a pair of inwardly projecting embossments between which the slightly outwardly extending flanges of the upper closure part snap in during closing of the closure member.

The lower closure part is provided at one end thereof with a cutout in the bottom portion extending over the whole width of the lower closure part, in which, during shortening of the deployment band an end portion of the one watch band half may be located to be, in the closed position of the closure member, elastically pressed against the wrist of the user by the other watch band half. This will prevent even if the length of the employment band is shortened to a considerable extent an increase of the thickness thereof since only the two watch band halves will be located flat above each other.

The arrangement of the set screws for securing the one watch band half in any adjusted position to the lower closure part has the advantage that the various elements of the deployment band can be manufactured with relatively large tolerances since the clearance between the fastening member and the corresponding watch band half may be bridged by corresponding turning of the set screws. Such a web like fastening member is flatter than any known clamping eccentric and produces due to its arrangement between the lateral flanges of the lower closure part no additional increase of the thickness of the closure member.

The closure member according to the present invention is formed of relatively simple parts so that with a minimum of technical expenditure a perfectly functioning adjustable deployment band may be constructed which engages the wrist of the user in a flat manner and in which the individual closure and band parts are located in the channel of the lower closure part so that the complete closure member forms a smooth closed very flat housing. Due to this construction, the deployment band of the present invention is also suitable for flat lady watch bands.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWING

FIG. 3 is a partial side view of the deployment band according to the modification shown in FIG. 2, in the closed position of the closure member;

FIG. 4*a* is a top view of the lower closure part according to the modification shown in FIG. 1;

FIG. 4*b* is a bottom view of the folding part of this modification; and

FIG. 4*c* is a bottom view of the upper closure part of this modification.

DESCRIPTION OF THE PREFERRED EMBODIMENTS

Figure 1:
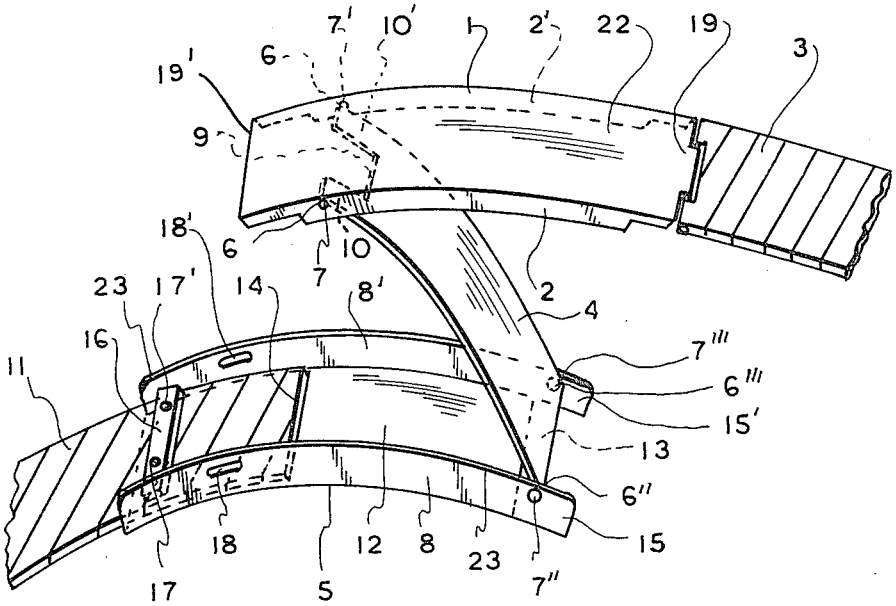
FIG. 1 is a perspective view of the closure member of the adjustable deployment band of the present invention and showing the closure member in open position.

Referring now to the drawing, and more specifically to FIG. 1 of the same, it will be seen that the deployment band according to the present invention comprises a closure member having an upper closure part 1 provided at opposite longitudinal edges thereof with downwardly extending slightly outwardly inclined flanges 2, 2', a lower closure part 5 having a bottom portion 12 and a pair of flange portions 8, 8' projecting upwardly from opposite longitudinal edges of the bottom portion thereof, and a folding part 4 connecting the upper closure part 1 to the lower closure part 5 for movement between an open position shown in FIG. 1 and a closed position in which the closure parts 1 and 5 interengage superimposed with each other with the folding part 4 located therebetween. For this purpose the folding part 4 is provided at opposite ends thereof respectively with a pair of trunnions 6, 6' respectively 6'', 6''' projecting laterally therefrom which are engaged into corresponding openings 7, 7' provided in the flanges 2, 2' of the upper closure part respectively into the openings 7'', 7''' provided in the flanges 8, 8' of the lower closure part 5.

The folding part 4 is provided at one end thereof which is hingedly connected to the upper closure part 1 with a cutout 9 extending from the end edge of the folding part 4 into the latter to form to opposite sides of the cutout 9 a pair of side lobes 10 and 10' from which the trunnions 6 and 6' respectively project integrally formed therewith. The side lobes 10, 10' permit an elastic snapping-in of the trunnions 6, 6' in the openings 7, 7' provided in the flanges 2, 2' of the upper closure part 1.

The lower closure part 5 forms between the bottom portion 12 and the flange portions 8 and 8' thereof a channel of substantially rectangular cross-section in which , as best shown in FIG. 1, one watch band half 11 of the deployment band is adjustably inserted engaging the bottom portion 12 of the lower closure part 5. The end of the other watch band half 3 is hingedly connected to the end 19 of the upper closure part 1. The lower closure part 5 is provided at one end thereof to which the folding part 4 is hingedly connected with a cutout 13 in the bottom portion 12 thereof extending over the whole width of the latter. If the watch band has a length so that the band half 11 adjustably located in the lower closure part 5 has to be moved in order to adjust the length thereof to the wrist of the user that the end 14 of the watch band half 11 projects beyond the lower closure part, then the band end portion 14 bends at closed position of the closure member under the pressure of the other band half 3 through the cutout 13 elastically towards the twist of the user. The band half 3 lays then flat on the projecting end 14 of the band half 11. In this way an increase of the thickness of the deployment band by extreme shortening of the latter is also avoided. At the same time, the projecting end portions 15, 15′ of the flanges 8, 8′ of the lower closure part 5 serve for an elastic attachment of the folding part 4 to the lower closure part 5.

A web shaped fastening member 16 is connected at opposite ends to the upwardly extending flanges 8, 8′ of the lower closure part 5 in such a manner that enough play remains between the fastening member 16 and the bottom portion 12 of the lower closure part 5 that the end portion of the one watch band half 11 is freely movable between the fastening member 16 and the bottom portion 12. At least one, or preferably two, set screws 17 and 17′ are screwed in threaded bores of the fastening member 16 to engage with the lower ends thereof the watch band half 11 so that the latter may be fixed in any adjusted position.

In the closed position of the closure member the slightly outwardly extending flanges 2, 2′ of the upper closure part 1 snap between two inwardly projecting embossments 18, 18′ provided closely rearwardly of the fastening member 16 in the flanges 8, 8′ of the lower closure part 5. The opening of the closure member can be performed by pulling the end 19′ of the upper closure part 1 in upward direction or by a pull in upward direction on the watch band half 3, whereby the flanges 2, 2′ of the upper closure part 1 are released from between the embossments 18, 18′.

Figure 2:
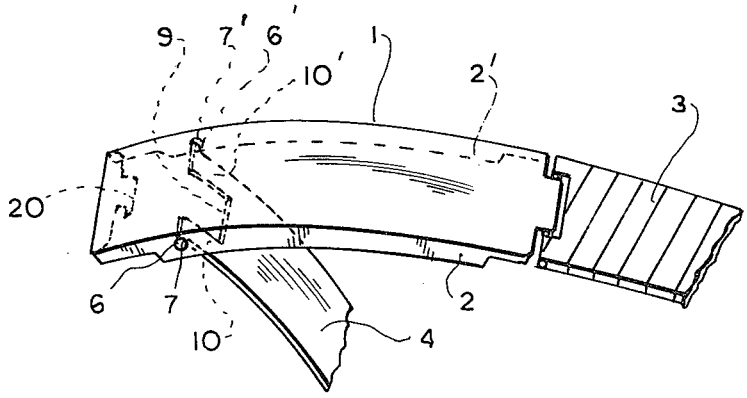
FIG. 2 is a partial perspective view of another modification in which the upper closure part is formed with a detent.

The embodiment partly illustrated in FIG. 2 differs from the above-described embodiment in that the upper closure part 1 has a bent detent 20 integrally formed at the end thereof opposite the end to which the watch band half 3 is connected which detent engages, in the closed position of the closure member the fastening member 16.

As shown in FIG. 4*b*, the bottom face of the folding part 4 is provided with columns 21 in which personal data of the owner of the watch band, as for instance, blood group, residence, etc., are to be inserted. These columns 2, may be directly etched into the bottom face of the folding part 4 whereby the data are then engraved into the columns 2, or the columns 2, may be printed on a label pasted to the bottom face of the folding part 4.

The length of the upper closure part 1 is dimensioned in such a manner that in the closed position of the closure member the band half 3 connected to the upper closure part 1 will not be located over the folding part 4 but rearwardly thereof, as shown in FIG. 3. The folding part 4 is located at the closed position of the deployment band between the fastening member 16 and the watch band half 3 connected to the upper closure part 1. The folding part 4 is located in this position between the downwardly extending flanges 2, 2′ of the upper closure part 1. The upper closure part 1 together with the folding part 4 will then be located between the upwardly extending flanges 8, 8′ of the lower closure part 5. The upper surface 22 of the upper closure part 1 is flush with the upper edges 23 of the lateral flanges 8, 8′ of the lower closure part 5 or projects only slightly beyond these edges 23 so that in the closed, position of the closure member the latter forms a closed smooth very shallow housing in which an end portion of the watch band half 11, the closure member 16 and the folding part 4 are located invisible from the outside thereof.

It will be understood that each of the elements described above, or two or more together, may also find a useful application in other types of adjustable deployment bands differing from the types described above.

While the invention has been illustrated and described as embodied in an adjustable deployment band it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An adjustable deployment band, comprising two watch band halves; and a foldable closure member having a lower closure part to which one of said watch band halves is adjustably connected, an upper closure part to which one end of the other watch band half is connected, and a folding part connecting said upper and said lower closure parts for movement between a closed position in which said closure parts interengage superimposed with each other and an open position, said end of said other watch band half extending laterally of said folding part in said closed position, said lower closure part being formed as a channel of a substantially rectangular cross-section in which one end portion of said one watch band half is shiftably arranged, and having a bottom portion and a pair of flange portions projecting upwardly from opposite edges of said bottom portion; means for fixing said end portion in any shifting position including a fastening member extending upwardly spaced from said bottom portion between said flange portions fixed to the latter, said end portion of said one watch band half extending in said channel beneath said fastening member; and means on said fastening member for pressing said end portion of said one watch band half against said bottom portion of said lower closure part, said pressing means including at least one set screw screwed in said fastening member and engaging with one end thereof said end portion of said one watch band half.

2. An adjustable deployment band as defined in claim 1, wherein said upper closure part has a pair of transversely spaced downwardly projecting flange portions between which said folding part is located in said closed position of said closure member.

3. An adjustable deployment band as defined in claim 1, wherein a pair of flange portions projecting upwardly from opposite edges of said bottom portion and wherein said upper closure part in the closed position of said closure member is located between said flange portions.

4. An adjustable deployment band as defined in claim 1, wherein said folding part has at each of its opposite ends a pair of trunnions projecting laterally therefrom, said flange portions of said upper and said lower closure part being provided in the regions of the ends thereof, opposite of the ends to which said watch band halves are connected with openings into which said trunnions respectively extend.

5. An adjustable deployment band as defined in claim 4, wherein said trunnions are integral with said folding part.

6. An adjustable deployment band as defined in claim 4, wherein said folding part is formed at one end thereof connected to said upper closure part with a central cutout extending from an end edge thereof thereinto to provide to opposite sides of said cutout a pair of elastic lobes from which one pair of said trunnions project so that said trunnions may be snapped into the respective openings by elastically deforming said lobes.

7. An adjustable deployment band as defined in claim 1, wherein said folding part is substantially flat and formed from heavier sheet metal than said closure parts.

8. An adjustable deployment band as defined in claim 7, wherein said folding part is formed from sheet metal of a thickness about double that of said closure parts.

9. An adjustable deployment band as defined in claim 1, wherein said folding part has a bottom face which is visible in the open position of said closure member and including means on said bottom face of said folding part indicating personal data of the owner of the deployment band.

10. An adjustable deployment band as defined in claim 1, wherein said fastening member is located near one end of the lower closure part so that in the closed position of the closure member said folding part will be located between said fastening member and the other watch band half.

11. An adjustable deployment band as defined in claim 1 wherein said fastening member has a face directed away from said other watch band half and wherein said upper closure part is provided with a curved detent engaging in said closed position of the closure member said face of said fastening member.

12. An adjustable deployment band as defined in claim 1, wherein said in the flange portions in the area adjacent said fastening member have a pair of inwardly projecting embossments and wherein said upper closure part has a pair of transversely spaced downwardly projecting flanges which deviate slightly in outward direction from each other and which snap in the closed position of the closure member behind said embossments.

13. An adjustable deployment band as defined in claim 1, wherein said lower closure part is provided at one end therof with a cutout in said bottom portion extending over the whole width of said lower closure part in which during shortening of said deployment band an end portion of said one watch band half may be located to be, in the closed position of said closure member, elastically pressed against the wrist of the user by said other watch band half.

14. An adjustable deployment band as defined in claim 1, wherein said upper and said lower closure parts are constructed and arranged with respect to each other to form in the closed position of said closure member, a closed, smooth, very shallow housing in which an end portion of said one watch band half and said folding part and said fastening member are located.

* * * * *